United States Patent [19]

Ream

[11] 4,450,837

[45] May 29, 1984

[54] UNDERWATER BREATHING APPARATUS

[75] Inventor: Norman E. Ream, Woodland, Calif.

[73] Assignee: Kelsey W. Hatcher, Woodland, Calif.

[21] Appl. No.: 385,338

[22] Filed: Jun. 7, 1982

[51] Int. Cl.[3] ..... A62B 7/00

[52] U.S. Cl. ..... 128/201.27; 128/204.29

[58] Field of Search ..... 128/201.27, 201.28, 128/204.28, 204.29, 205.11, 205.12, 205.17

[56] References Cited

U.S. PATENT DOCUMENTS

| | | | |
|---|---|---|---|
| 3,316,905 | 5/1967 | Seeler | 128/204.28 |
| 3,875,957 | 4/1975 | Veit et al. | 128/205.11 X |
| 4,037,594 | 7/1977 | Riegel et al. | 128/201.27 |
| 4,060,076 | 11/1977 | Botos et al. | 128/204.9 |

*Primary Examiner*—Edward M. Coven

*Attorney, Agent, or Firm*—Lothrop & West

[57] ABSTRACT

Underwater breathing apparatus immediately provides two liters of fresh air from the fresh air tank to a diver at any reasonable depth as inhalation begins. The necessary additional volume of gas in order to equalize the pressure of the ambient environment is automatically derived from a mixture of fresh air and recycled air, devoid of carbon dioxide and moisture, provided by an ambient pressure compensating diaphragm and associated chamber which is also in communication with the means for connecting the apparatus with the breathing organs of the diver.

3 Claims, 3 Drawing Figures

12
13
42
41
11

16
17
18
19
44
46
21
36
38
33
TO OTHER TANK
14
22
32
28
27
29
24
26
23
49
47
48

UNDERWATER BREATHING APPARATUS

FIELD OF THE INVENTION

The invention relates to apparatus enabling a person to breathe while underwater and, more particularly, it relates to underwater breathing apparatus which is not only reliable and relatively inexpensive but which is more efficient than the prior art devices in that it greatly reduces the undesirable waste of oxygen heretofore encountered.

BACKGROUND OF THE INVENTION

Self-contained underwater equipment, such as that used by "scuba" or "skin" divers, has long been known. The most common form of such self-contained apparatus suffers from a drawback, however, in that the air from an air supply tank is allowed to escape after having been breathed by the diver. Not all of the available oxygen is extracted during breathing and oxygen is thus wasted when the exhaled air is ejected.

For certain sport and military applications, diving equipment has been developed which is not only self-contained, but is also recirculating in the sense that a canister containing a carbon dioxide absorbing material is introduced into the breathing circuit, along with a breathing bag capable of holding exhaled oxygen until it can subsequently again be inhaled under suitable conditions.

There remains, however, considerable room for improvement, especially from the aspect of complexity and cost of acquisition and upkeep.

SUMMARY OF THE INVENTION

The underwater breathing apparatus of the present invention includes many of the components in a conventional high quality rig such as that used in ordinary scuba diving.

Added to these standard components, however, are elements which are constructed and connected in such a manner as to cause two liters of fresh air from the air source to be made instantly available to the diver at each inhalation. Concurrently, a secondary supply of recirculated air containing some residual oxygen, but free of moisture and carbon-dioxide, is enriched by an infusion of fresh air and brought up to ambient pressure.

The two liters of fresh air inhaled by the diver not only contain a full measure of oxygen required by the diver but the quantity of fresh air remains substantially constant regardless of ambient environmental pressure owing to the provision of a special compensating device, such as a valve cooperating with a rolling diaphragm exposed to the surrounding water pressure.

As the diver descends, the pressure of the ambient environment increases, opening the valve and admixing fresh air with the recycled air until pressure is equalized.

BRIEF DESCRIPTION OF THE DRAWING FIGURES

DETAILED DESCRIPTION OF A PREFERRED EMBODIMENT OF THE INVENTION

For a better understanding of the present invention a short discussion of the air requirements during diving is believed to be helpful.

At sea level, air contains, except for small amounts of other gases, approximately 79% nitrogen and 21% oxygen. When air at sea level is exhaled from human lungs, it contains about 79% nitrogen, 16% oxygen, 4% carbon dioxide and water vapor. The carbon dioxide and moisture are, in the present device, removed and the resultant gas is pressurized by the addition of fresh air containing oxygen. By raising the pressure to that of the ambient environment and also making two liters of fresh air instantly available the present apparatus is made regenerating as well as recirculating.

Although the oxygen requirements of a person subjected to water pressure remains substantially constant as to mass, the volume required varies in accordance with Boyles' Law of gasses, referring to the inverse relationship between pressure and volume.

By providing appropriate regulating and pressure compensating means, the necessary amount of air can be added from the air source to the "scrubbed" exhaled air to meet the diver's volumetric requirements at any depth, i.e. at any ambient water pressure, while, at the same time, the necessary oxygen mass is provided by the immediately available two liters of fresh air.

Figure 1:
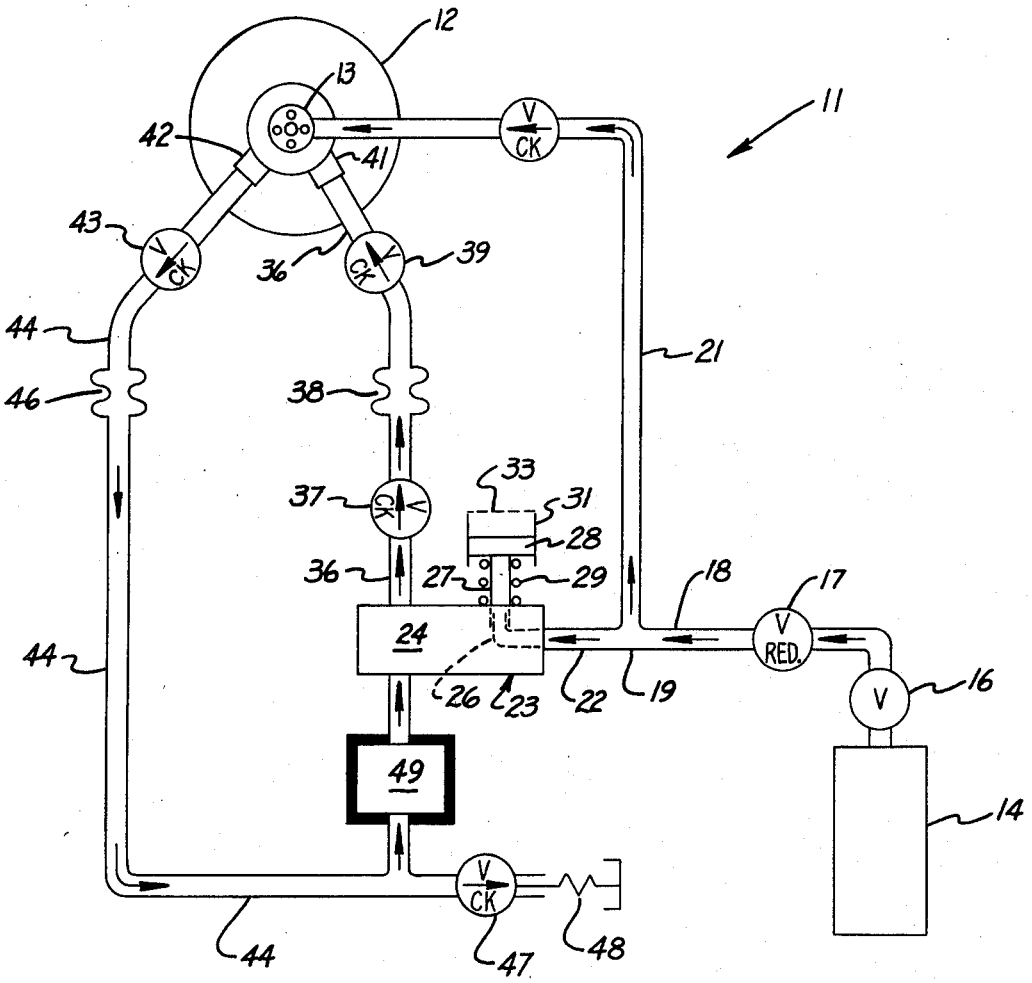
FIG. 1 is a block diagram of a preferred embodiment of the invention.

With particular reference to the block diagram, or flow diagram, of FIG. 1, it can be seen that the underwater breathing apparatus of the invention, generally designated by the reference numeral 11, is used to provide the proper amount of air to a diver equipped with a suitable full face mask 12, or the like, having a conventional demand regulator 13.

The diver's source of air is one or more tanks 14, or bottles, containing air at a pressure of approximately 2000 to 5000 pounds per square inch. If two bottles are used, each bottle could be of a size containing 50 cubic feet of air, for example, thereby enabling the diver to descend to a considerable depth for an extended period of time without undue encumbrance.

The tank 14, as well as the other components, except the face mask 12 and demand regulator 13, is secured to a conventional frame (not shown) which is strapped to the diver in customary fashion.

The tank 14 is provided with the usual shut off valve 16 and reducing valve 17 which reduces the air pressure to about 110 p.s.i.

A conduit 18 extends from the reducing valve 17 to a T-fitting 19 from which one branch 21 extends to the demand regulator 13, and the other branch 22 connects to an ambient pressure compensator 23.

The pressure compensator 23 includes a chamber 24 housing a suitable valve 26, of the sleeve type, for example, connected to a plunger 27 and piston head 28 urged upwardly against downward ambient pressure by a coil spring 29.

Figures 2, 3:
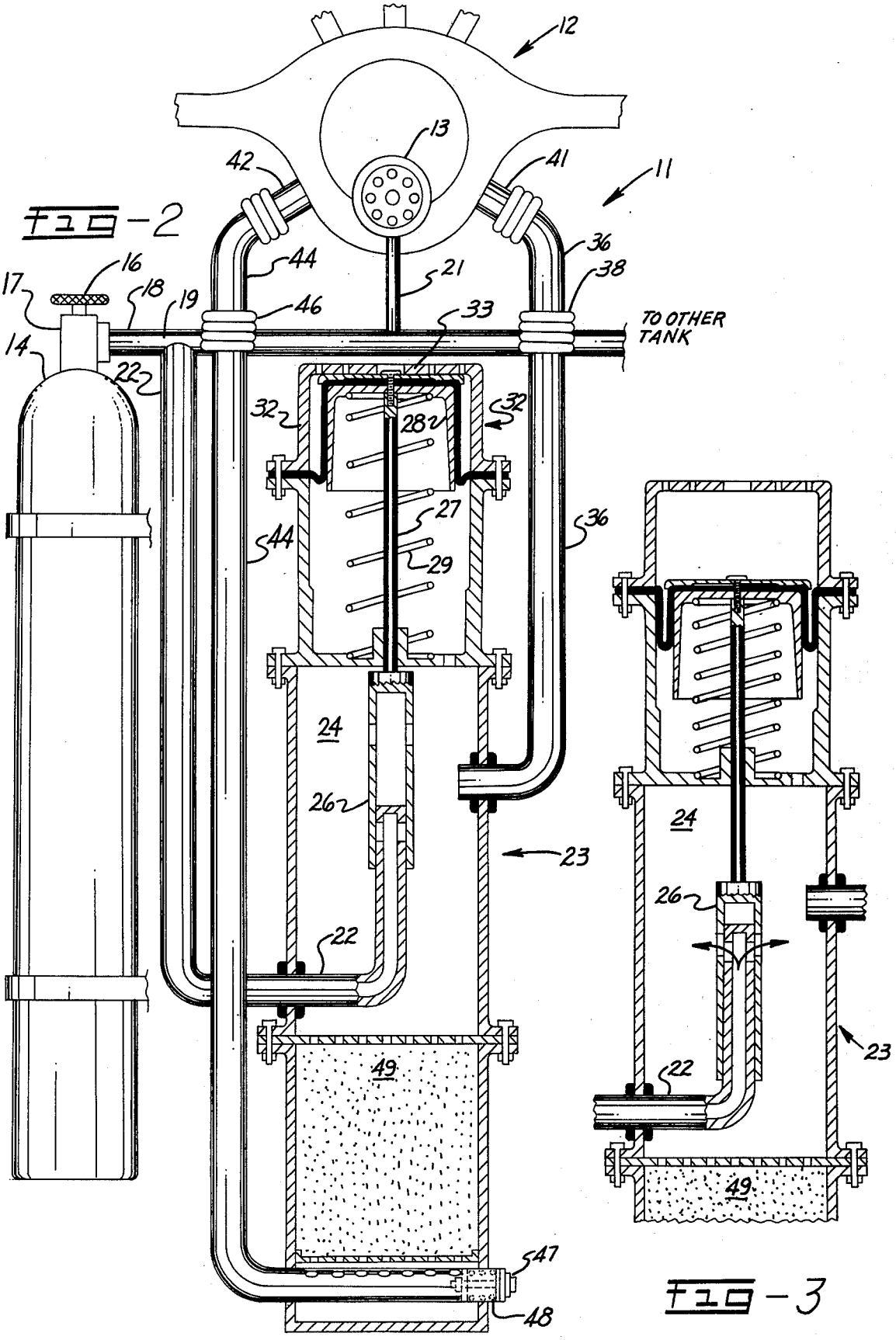
FIG. 2 is a schematic representation thereof, partially in section, showing the rolling diaphragm in uppermost position; and, FIG. 3 is a fragmentary sectional view of the rolling diaphragm in a lowered position.

Preferably, the piston head 28 and attendant cylinder 31 are of the type commonly known as a rolling diaphragm 32. The top of the rolling diaphragm is provided with a transverse screen 33 which permits the ambient water pressure to bear downwardly on the top of the piston head, the pressure being resisted by the spring 29. The gas within the chamber 24 is in communication with the bottom of the piston head 28 through an aperture in the top of the chamber 24, as shown in FIGS. 2 and 3.

As will subsequently be described in more detail, the greater the ambient pressure, the farther the plunger 27 descends and the greater the quantity of fresh air from the conduit 22 released through the valve 26 into the chamber 24 of the ambient pressure compensator 23.

Emerging from the chamber 24 is an intake hose 36 provided with a check valve 37 and flexible connection 38. Air in the intake hose 36 then passes through an intake check valve 39 and intake hose fitting 41 and enters the face mask 12.

The demand regulator 13 is of conventional make and, as inhalation occurs, quickly releases two liters of fresh air routed through the conduit 18 to the branch 21 leading from the tank 14.

The two liters of fresh air released into the face mask are immediately inhaled by the diver and satisfy the diver's oxygen mass requirements.

The ambient pressure compensator 23 and the demand regulator 13 cooperate not only to provide the necessary two liters of fresh air but also the additional quantity of gas required to match the pressure of the ambient environment.

As the diver exhales, the "oxygen depleted" and "carbon-dioxide containing" air emerges through an exhaust hose fitting 42, thence through a check valve 43 into an exhaust hose 44 with flexible connection 46.

Adjacent the lowest portion of the exhaust hose 44 is a spring-loaded pop-off valve 47, or check valve, through which condensate, exhaled air, along with saliva, etc. is ejected each time the pressure in the exhaust hose 44 exceeds the biasing constant of the check valve spring 48.

As the air ascends from the region of the pop-off valve 47 it passes through a canister 49 filled with a suitable combined desiccant and carbon-dioxide absorbing material.

Upon emerging from the $CO_2$ absorber 49, the air is relatively dry and free of $CO_2$.

An infusion of fresh air, from the compensator 23, raises the chamber pressure so that the valve 26 closes under the force of spring 29 enabling the relatively dry and $CO_2$ free gas mixtture to be re-cycled into the intake hose 36 and routed to the face mask 12 along with the fresh air infusion.

At a depth of thirty-three feet, the ambient pressure is about twice atmospheric, or about 30 p.s.i. At this depth, the diver's lungs need a pressure of twice atmospheric. In other words, the two liters of fresh air from the tank 14 which are inhaled by the diver at a depth of thirty-three feet suffice insofar as oxygen content is concerned, but a volume of air close to four liters in the lungs is required to meet ambient pressure requirements. These two additional liters are obtained from the mixture of fresh air plus recycled exhaled air at ambient pressure in the compensating chamber 24, or "breathing bag", as it is sometimes designated.

At a depth of sixty six feet, the ambient pressure is thrice atmospheric and in addition to the injection of two liters of fresh air into the full face plate mask 12 (which provides the diver with the required "mass" of oxygen for a single breath, or inhalation) an additional four liters of gas are needed to meet the pressure requirements exacted by the ambient environment.

At ninety nine feet, two liters of fresh air and six liters of mixed fresh air and "recycled" exhaled air are needed. Etc.

As previously indicated, the additional liters of mixed fresh air and "recycled" exhaled air which pass from the compensating chamber 24 through the intake hose 36 to the face mask 12, thence to the diver's lungs, as each inhalation occurs, vary in dependence upon the ambient pressure which, in turn, is a function of depth. As the diver enters the water and begins to descend, the force exerted on the top of the piston head 28 increases until, at a depth determined by the valve parameters and spring constant of the spring 29, the plunger 27 is translated from the position shown schematically in FIG. 2 to that shown schematically in FIG. 3, thereby allowing fresh air from the tank 14 to flow through the conduit 22 and into the chamber 24, as indicated by the directional arrows in FIG. 3. The physical dimensions of the valve 26, the piston head 28 and the constant of the spring 29 are selected so that sufficient fresh air from the tank 14, at about 110 p.s.i., is released into the chamber 24 to close the valve 26 when the chamber 24 possesses the amount of gas needed by the diver's lungs at the particular depth. As the diver continues to descend a greater quantity of additional fresh air must be introduced from the tank 14, the necessary quantity being a readily calculated amount since it is a function of depth.

As will be obvious, the quantity of additional fresh air required as the diver ascends will decrease, dropping to zero as the diver surfaces since, at this juncture, the lungs need only the two liters of fresh air, at each inhalation, provided by the demand regulator 13.

One of the numerous advantages of the disclosed embodiment is that the "scrubbed" exhaled air contains about 16% oxygen and in the ambient pressure compensator 23, this percentage of oxygen is enhanced by the infusion of fresh air from the tank which contains 21% oxygen. Thus, if for some reason the tank suddenly fails to provide more fresh air, there is still available some breathable gas although the oxygen content is diminished. There is not a sudden cut-off, as often occurs with prior devices in which all the exhaled gas is discharged into the ambient environment and no more air is available either fresh or recycled.

Another advantage of the present invention is that in many circumstances the constant of the biasing spring of the pressure compensating valve yields a slight "vacuum" in the chamber, thereby making it easier for the diver to exhale. In other words, as the diver moves from one depth to another, the compensator spring slightly moves the rolling diaphragm beyond pressure balancing position, in which event the compensator chamber 24 is somewhat enlarged and the slight "vacuum" helps the diver to exhale.

I claim:

1. A self-contained underwater breathing apparatus comprising:

a. a fresh air container;

b. a primary fresh air breathing supply circuit including a face mask, a first conduit extending from said fresh air container to said face mask, and a demand regulator on said face mask having a metering orifice releasing approximately two liters of fresh air to the breathing organs of the user during each inhalation cycle of the user's breathing organs;

c. a secondary recirculating gas breathing supply circuit including a chamber, an exhaust hose connecting said face mask to said chamber to conduct thereto air exhaled from the breathing organs of the user during each exhalation cycle, a $CO_2$ and moisture absorbing canister interposed in said exhaust hose, and an intake hose connecting said chamber to said face mask;

d. a fresh air makeup supply circuit including a second conduit in communication with said fresh air container and extending to said chamber for the transfer of fresh air thereto;

e. a valve located within said chamber and connected to said second conduit; and, f. piston means associated with said valve for sensing the water pressure of the ambient environment and controlling said valve to effect the release of fresh air into said chamber in an amount dependent upon the water pressure, the dimensions of said valve and said piston means being selected to afford to the user's breathing organs the quantity of fresh air plus recycled exhaled air needed, in conjunction with the two liters of fresh air released from said demand regulator, to meet both the oxygen requirements and the pressure requirements of the user's breathing organs exacted by the ambient environment at each inhalation.

2. An apparatus as in claim 1 including a pop-off valve interposed in said exhaust hose of said secondary recirculating gas breathing supply circuit between said face mask and said canister, said pop-off valve discharging at least a portion of the exhaled air in said exhaust hose should the pressure in said exhaust hose exceed the ambient pressure.

3. An apparatus as in claim 2 in which said piston means includes a rolling diaphragm and a piston head movable in response to the pressure of the ambient environment, a valve operator connecting said piston head and said valve, and spring means for biasing said piston against the opposing pressure of the ambient environment.

* * * * *